US009104164B2

(12) United States Patent
Shiraishi

(10) Patent No.: US 9,104,164 B2
(45) Date of Patent: Aug. 11, 2015

(54) MEDIUM CARRYING DEVICE, IMAGE FORMING DEVICE, AND MEDIUM CARRYING METHOD

(75) Inventor: Toyokazu Shiraishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 878 days.

(21) Appl. No.: 13/015,776

(22) Filed: Jan. 28, 2011

(65) Prior Publication Data

US 2011/0194861 A1 Aug. 11, 2011

(30) Foreign Application Priority Data

Feb. 10, 2010 (JP) ..... 2010-027727

(51) Int. Cl.
*B65H 26/02* (2006.01)
*G03G 15/00* (2006.01)

(52) U.S. Cl.
CPC ..... *G03G 15/70* (2013.01); *B65H 26/02* (2013.01); *B65H 2511/528* (2013.01); *G03G 2215/00455* (2013.01)

(58) Field of Classification Search
CPC ..... G03G 15/5012; B65H 2402/1452
USPC ..... 399/18, 19, 20, 21, 400, 397, 388, 384, 399/385, 68
See application file for complete search history.

(56) References Cited

U.S. PATENT DOCUMENTS

| | | | | |
|---|---|---|---|---|
| 5,179,417 | A * | 1/1993 | Sugaya et al. | 399/361 |
| 5,204,726 | A * | 4/1993 | Choi | 399/21 |
| 5,548,390 | A * | 8/1996 | Sugisaki et al. | 399/364 |
| 2004/0074407 | A1 * | 4/2004 | Iyokawa et al. | 101/228 |
| 2006/0045548 | A1 * | 3/2006 | Takiguchi | 399/21 |
| 2006/0269301 | A1 * | 11/2006 | Ogasawara | 399/21 |

FOREIGN PATENT DOCUMENTS

| | | | | |
|---|---|---|---|---|
| JP | 2006153999 A | * | 6/2006 | G03G 15/20 |
| JP | 2007076846 | * | 3/2007 | B65H 43/00 |

* cited by examiner

*Primary Examiner* — Jill Culler
*Assistant Examiner* — Ruben Parco, Jr.
(74) *Attorney, Agent, or Firm* — Muncy, Geissler, Olds & Lowe, P.C.

(57) ABSTRACT

A medium carrying device includes: first and second carrying part that carry a medium to a second position via a first position; a slack detection unit positioned between the first and second carrying part and detecting slack in the medium; a medium carrying detection part that detects a carrying state of the medium; an input part that receives a recovery instruction when an abnormality is detected in the carrying state of the medium by the medium carrying detection part; a controller that stops the carrying of the medium by the first and second carrying parts when the abnormality is detected in the carrying state of the medium by the medium carrying detection part and that resumes the carrying of the medium by the first and second carrying parts according to a detection result by the slack detection part when the input part receives the recovery instruction.

28 Claims, 9 Drawing Sheets

MEDIUM CARRYING DEVICE, IMAGE FORMING DEVICE, AND MEDIUM CARRYING METHOD

CROSS REFERENCE TO RELATED APPLICATION

The present application is related to, claims priority from and incorporates by reference Japanese patent application number 2010-027727, filed on Feb. 10, 2010.

BACKGROUND

This invention relates to a medium carrying device that carries a medium, such as a recording medium, an image forming device that includes the medium carrying device, and a medium carrying method.

Conventionally, in an image forming device, such as a color page printer, when an elongated medium, such as a continuous sheet, becomes jammed, and this abnormality is detected, the image formation motion needs to be immediately stopped, and the user is required to open the device cover and to remove the jammed medium.

Japanese Laid-Open Patent Application No. 2007-76846 discloses a technique that, when such an abnormality is detected, the image forming motion is stopped, and that, when the medium carrying state is automatically recoverable, the carrying state of the continuous sheet is automatically recovered to a normal state, and the image forming motion is turned into a recordable state, without the need for a jam recovery process by the user.

SUMMARY

However, when a jam occurs as a medium is strained and thus cannot be carried, it has been difficult to perform the automatic jam recovery process. As a result, the jam recovery process is cumbersome.

Embodiments of the present invention have an object to reduce the cumbersome nature of the jam recovery process.

A medium carrying device of the application includes: a first carrying part that carries a medium to a first position; a second carrying part that is positioned on a downstream side of the first carrying part and that carries the medium carried from the first carrying part to a second position; a slack detection unit that is positioned between the first carrying part and the second carrying part and that detects slack in the medium; a medium carrying detection part that detects a carrying state of the medium; an input part that receives a recovery instruction from a user when an abnormality is detected in the carrying state of the medium by the medium carrying detection part; a controller that stops the carrying of the medium by the first carrying part and the second carrying part when the abnormality is detected in the carrying state of the medium by the medium carrying detection part and that resumes the carrying of the medium by the first carrying part and the second carrying part according to a detection result by the slack detection part when the input part receives the recovery instruction from the user.

In another aspect of the application, an image forming device includes an image forming part configured to form an image on a medium, the image forming part including a medium carrying device having a first carrying part configured to carry the medium to a first position, and a second carrying part that is positioned on a downstream side of the first carrying part and that is configured to carry the medium carried from the first carrying part to a second position; registration medium carrying rollers that are located on an upstream side of the image forming part and configured to carry the medium to the image forming part; and a writing sensor that is located between the registration medium carrying rollers and the image forming part and that is configured to detect both a timing at which the image forming part forms the image and slack in the medium; a slack detection part that is in communication with the writing sensor and that is configured to detect the slack in the medium based on signals from the writing sensor; a controller that is in communication with the slack detection part and that is configured to control respective speeds of the first carrying part, the second carrying part and the registration medium carrying rollers when the slack detection unit detects the slack in the medium to remove the slack in the medium.

In another aspect of the application, a medium carrying method includes: a first carrying process for carrying a medium; a second carrying process for carrying the medium carried by the first carrying process; a medium carrying abnormality detection process for detecting a carrying state of the medium; a slack detection process for detecting slack in the medium when the medium carrying abnormality detection process detects that the carrying state of the medium is abnormal; and a medium carrying and ejection process for resuming the carrying of the medium by the first and second carrying processes according to a detection result of the slack in the medium by the slack detection process.

With the above configurations, the cumbersome nature of the jam recovery process is reduced.

DETAILED DESCRIPTION OF THE INVENTION

Configuration for implementing the present invention is believed to be apparent in light of the explanation of the below preferred embodiments and the accompanying drawings. However, the drawings are for explanation purposes only and are not intended to limit the scope of the present invention.

First Embodiment (Configuration of Image Forming Device in First Embodiment)

Figure 1:
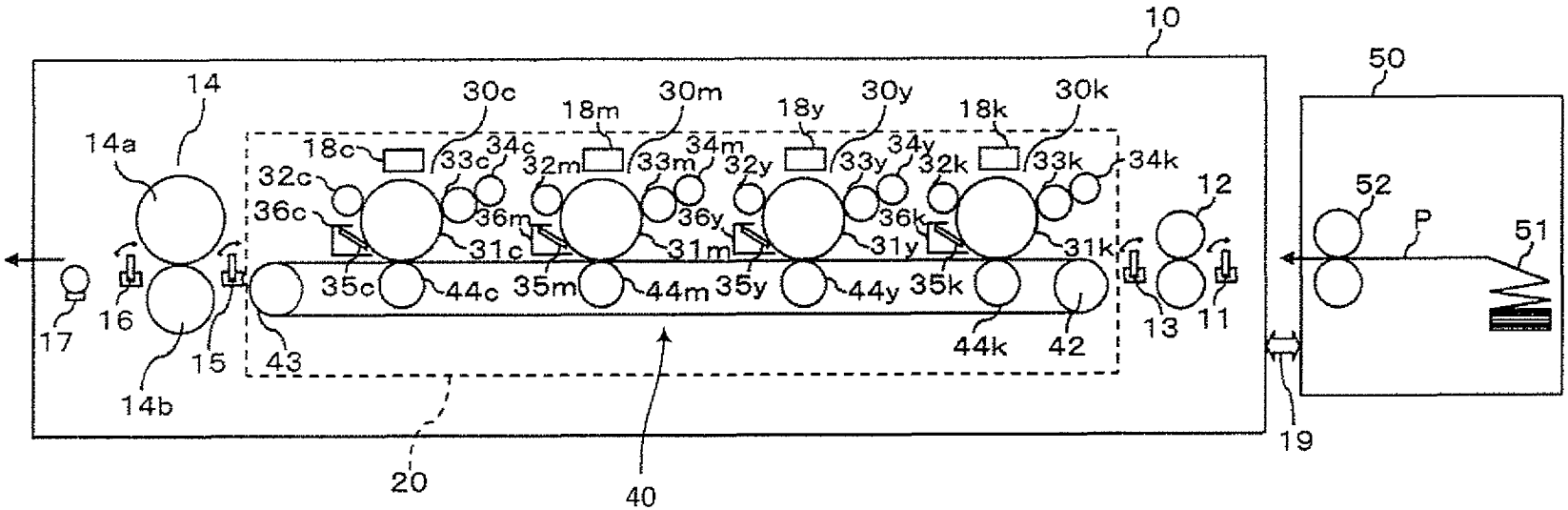
FIG. 1 is a diagram schematically illustrating an image forming device in a first embodiment of the present invention.

An image forming device 10 in FIG. 1 is an electrophotographic color printer to which a sheet supply mechanism 50 is connected. The sheet supply mechanism 50 includes a continuous sheet reel 51 that accommodates a medium (e.g., continuous sheet) P and registration medium supply rollers 52 that supply the continuous sheet P to the image forming device 10.

The image forming device 10 includes a sheet supply sensor 11 that detects whether or not the continuous sheet P is being supplied, registration medium carrying rollers 12 that carry the continuous sheet P to an image forming part 20, the image forming part 20 that forms the image, and a writing sensor 13 that detects a timing for forming the image by the image forming part 20.

The image forming part 20 includes a plurality of image forming units 30 (30*k*, 30*y*, 30*m*, 30*c*) that form a toner image T in black (k), yellow (y), magenta (m) and cyan (c), respectively onto the continuous sheet P along a carrying direction of the continuous sheet P, a plurality of exposure parts 18 (18*k*, 18*y*, 18*m*, 18*c*) and a transferring unit 40 that transfers the image onto the continuous sheet P and that carries the continuous sheet P.

Respective configurations of the image forming units 30, the exposure parts 18 and the transferring unit 40 will be explained.

Each image forming unit 30 includes a photosensitive drum 31 (31*k*, 31*y*, 31*m*, 31*e*), a charging roller 32 (32*k*, 32*y*, 32*m*, 32*c*) that charges the photosensitive drum 31, a developing roller 33 (33*k*, 33*y*, 33*m*, 33*c*) that supplies toner to the photosensitive drum 31, a supply roller 34 (34*k*, 34*y*, 34*m*, 34*c*) that supplies the toner to the developing roller 33, a photosensitive body cleaning device 35 (35*k*, 35*y*, 35*m*, 35*c*) that cleans the residue toner on the photosensitive drum 31, and a waste toner box 36 (36*k*, 36*y*, 36*m* 36*c*).

The plurality of exposure parts 18 is arranged to face the respective photosensitive drum 31. Each exposure part 18 forms an electrostatic latent image by exposing the surface of the respective photosensitive drum 31 and is configured from a light emitting diode array (LED array).

The transferring unit 40 includes a first carrying part (e.g., a drive system for the transferring unit 40) and a plurality of transferring rollers 44 (44*k*, 44*y*, 44*m*, 44*c*). The first carrying part is configured from a transferring belt 41 that carries the continuous sheet P, a transferring belt drive roller 43 that drives the transferring belt 41, and a transfer belt idle roller 42 that rotates as driven by the transfer belt drive roller 43. The plurality of transferring rollers 44 (44*k*, 44*y*, 44*m*, 44*c*) transfers the toner image T on the respective photosensitive drum 31 onto the continuous sheet P by applying a voltage. A configuration of the image forming part 20 is as described above.

In addition, the image forming device 10 includes a fusing unit 14 that fixes a developer image (e.g., toner image) T formed on the continuous sheet P onto the continuous sheet P by heating and pressing the developer image T. The fusing unit 14 includes a heating roller 14*a* and a pressure application roller 14*b* and is configured to carry the continuous sheet P by pressing the heating roller 14*a* and the pressure application roller 14*b*. The heating roller 14*a* and the pressure application roller 14*b* form a drive system for the fusing unit 14 and are configured as a second carrying part.

The image forming unit 10 includes a slack sensor 15 that includes a lever and an optical sensor. The slack sensor 15 tilts (becomes down position) as a result of tension applied to the continuous sheet P between the image forming part 20 and the fusing unit 14, and may stand upright (becomes up position) as a result of slack in the continuous sheet P. The positions of the lever are detected by the optical sensor. Moreover, at the second position, which is on the downstream side of the fusing unit 14, the image forming device 10 includes an ejection sensor 16 and an ejection motion sensor 17. The ejection sensor 16 includes a lever and an optical sensor, and detects existence of the continuous sheet P ejected from the fusing unit 14 by the tilting (down) or standing (up) of the lever. The ejection motion sensor 17 detects a jam of the continuous sheet P based on the on or off status of the carrying motion of the print medium. The status is detected by the ejection motion sensor 17 contacting the continuous sheet P ejected from the fusing unit 14 and by its own rotation. In the invention, any lever, which is configured to have at least two different positions according to the sheet states (e.g. slack or no slack), is available. As long as the lever changes its position according to the slack in a medium, a linear movement as well as the rotation or pivot movement discussed above is applicable for the lever. The linear movement means, for example, that the lever travels forward and backward with respect to a sheet carrying surface according to the sheet states (slack or no slack). Furthermore, any lever, which is configured to have at least two different positions according to sheet contacting states (e.g. no contact state or contact state), is available. In addition, instead of the lever and the optical sensor that detects the sheet states, an optical sensor, for example, that detects the presence of a medium in its proximity by reflection of laser or the like may be used.

A communication cable 19 is a signal line that connects the image forming device 10 and the sheet supply mechanism 50.

The medium carrying device according to the first embodiment is configured from the drive system for the transfer unit 40, the slack sensor 15, the drive system for the fusing unit 14, the ejection sensor 16 and the ejection motion sensor 17.

Figure 2:
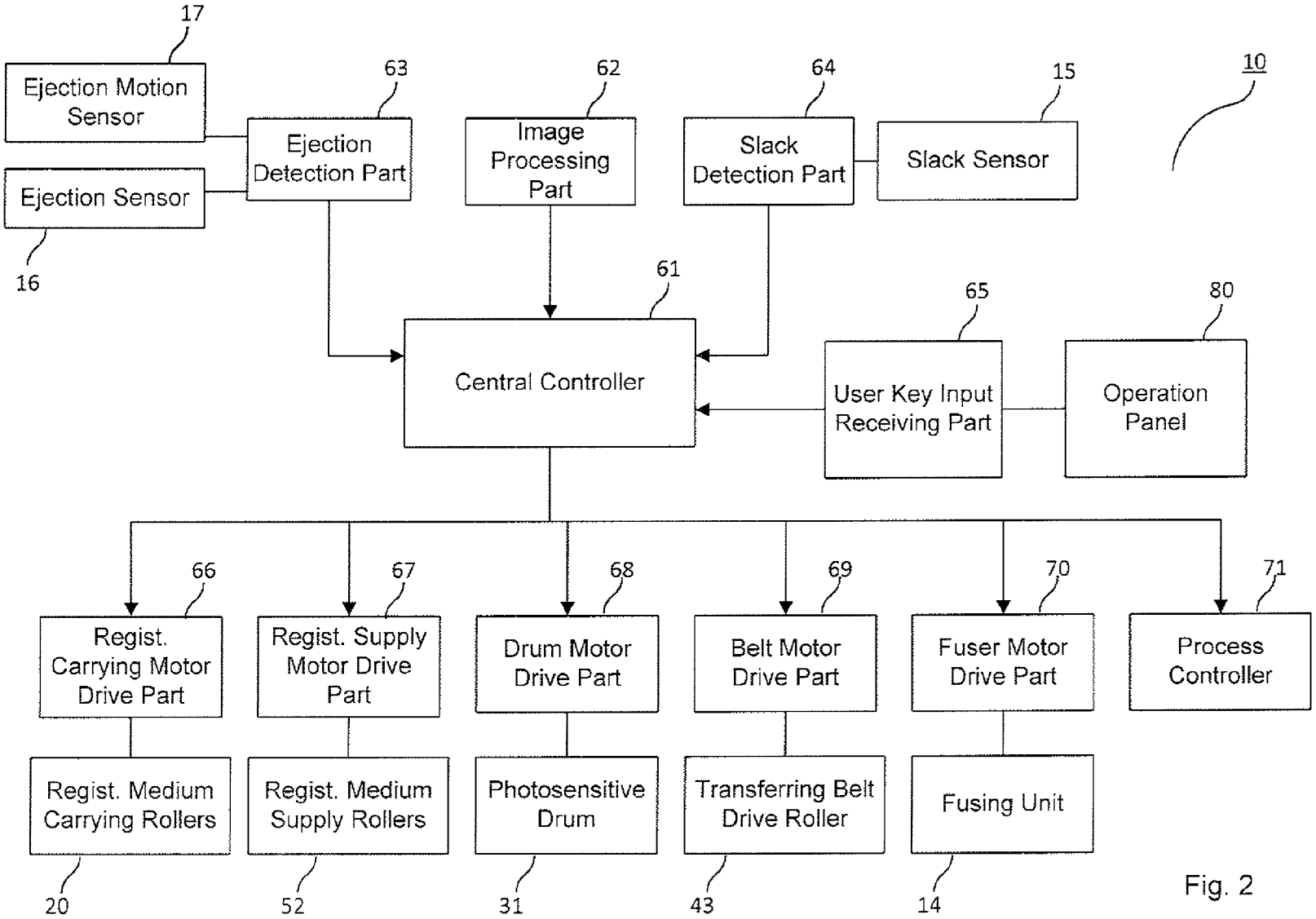
FIG. 2 is a functional block diagram illustrating the image forming device shown in FIG. 1 in the first embodiment of the present invention.

As shown in FIG. 2, the image forming device 10 includes a controller (e.g., a central controller 61). The central controller 61 includes a central processing unit (hereinafter "CPU"), such as a microprocessor, and a random access memory (hereinafter "RAM"). The central controller 61 controls the entire image forming device 10 by executing various programs stored in a read-only memory (hereafter "ROM") (not shown).

That is, various functional blocks are connected to the central controller 61 in the first embodiment. The central controller 61 has functions to receive signals from an image processing part 62, an ejection detection part 63, a slack detection part 64 and input means (e.g., user key input receiving part 65), which are the functional blocks connected to the central controller 61, and to control these various functional blocks for the later-discussed drive systems by outputting control signals thereto.

The image processing part 62 has a function to receive print data from a host device and to generate image data from the print data. The ejection detection part 63 has a function to detect signals from the ejection sensor 16 and the ejection motion sensor 17 and to monitor the existence of the continuous sheet P and occurrence of the carrying abnormalities (e.g., a jam).

The slack detection part 64 detects whether the continuous sheet P being carried has slack or is strained based on the state of the slack sensor 15, that is, by detecting whether or not the slack sensor 15 is tilted (down), as shown in FIG. 5. The slack sensor 15 and the slack detection part 64 form a slack determination unit. The user key input receiving part 65 receives key inputs when keys provided on an operation panel 80 are depressed and provides information relating to the key inputs to the central controller 61.

Next, each block for the respective drive system is described. A registration carrying motor drive part 66 controls the driving of the registration medium carrying rollers 12, which carry the continuous sheet P in FIG. 1 to the image forming part 20. A registration supply motor drive part 67 controls the driving of the registration medium supply rollers 52 in FIG. 1 via the communication cable 19. A drum motor drive part 68 controls the driving of the photosensitive drum 31 in FIG. 1. A belt motor drive part 69 controls the driving of the transferring belt drive roller 43 in FIG. 1. A fuser motor drive part 70 controls the driving of the drive system for the fusing unit 14 in FIG. 1.

The registration carrying motor drive part 66, the registration supply motor drive part 67, the drum motor drive part 68, the belt motor drive part 69 and the fuser motor drive part 70 include a stepping motor driver and have a function to control rotational motions based on a preprogrammed acceleration/deceleration table. A process controller 71 has a function to determine parameters for the charging, exposure, development and transferring for the toner image.

Figure 3:
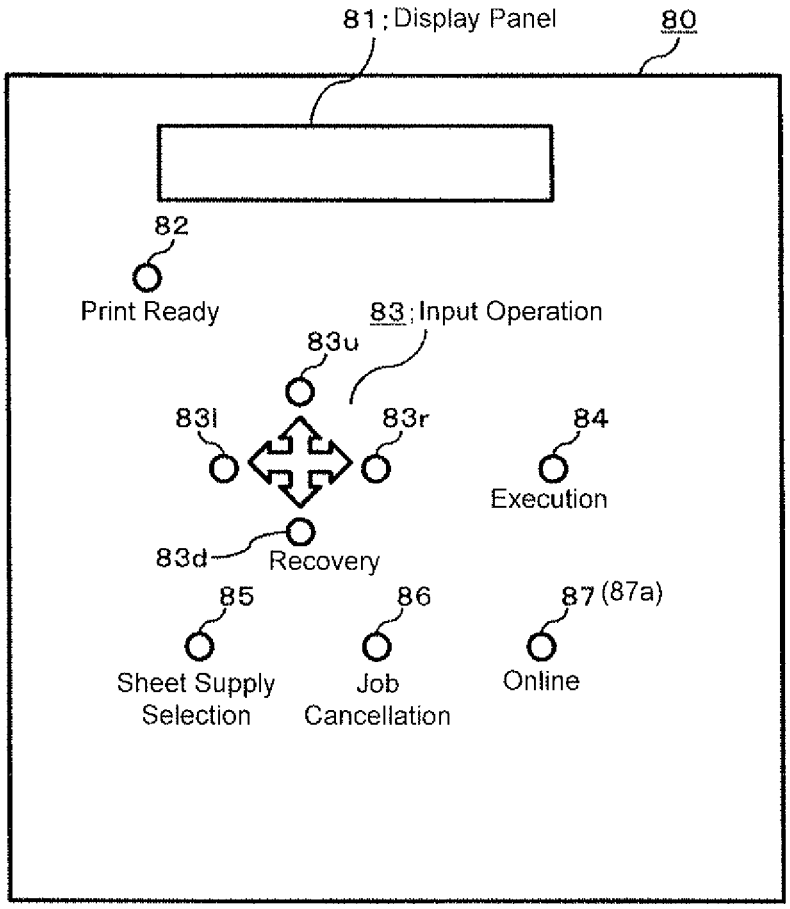
FIG. 3 is a diagram illustrating an example of an operation panel in FIG. 2.

As shown in FIG. 3, the operation panel 80 includes a display panel 81 that displays messages and guidance from the central controller 61 and the like, a print-ready lamp 82 that indicates that a print motion is possible, a plurality of input operation keys 83 (83*r*, 83*l*, 83*u* and 83*d*) for input operations, an execution key 84, which executes an item selected using the input operation keys 83, a sheet supply selection key 85, which designates the type of sheets to be supplied, a job cancellation key 86, which cancels the print job being executed, and an online key 87 with lamp, which displays an online or offline status and switches the online status and offline status when the key is depressed.

The online key 87 with lamp is referred to as an online lamp 87*a* when referring to display functions and as an online key 87 when referring to key functions. The online lamp 87*a* is illuminated when the image forming device 10 is in the online status and is unlit when it is in the offline status. The input operation key 83*d* is a recovery key which requests the image forming device 10 for a recovery from a trouble state.

(Print Motion of Image Forming Device in First Embodiment)

An outline of the print motion of the image forming device 10 of the first embodiment is explained using FIG. 1.

The continuous sheet P stored in the sheet supply mechanism 50 is fed by the registration medium supply rollers 52 through the continuous sheet reel 51 and is supplied to the image forming device 10. The continuous sheet P supplied to the image forming device 10 is carried to the image forming part 20 by the registration medium carrying rollers 12. The sheet supply sensor 11 is located on the upstream side of the registration medium carrying rollers 12 and detects existence of the continuous sheet P. The writing sensor 13 is located on the downstream side of the registration medium carrying rollers 12. The central controller 61 controls the timing for image formation on the continuous sheet P using the output signal of the writing sensor 13.

The surface of the photosensitive drum 31 charged by the charging roller 32 is exposed by the exposure part 18 to form an electrostatic latent image. The electrostatic latent image is developed by the developing roller 33, and a toner image T is formed on the photosensitive drum 31.

Next, toner images T in each of black, yellow, magenta and cyan are formed sequentially on the continuous sheet P when the continuous sheet P passes between the respective photosensitive drum 31 and transferring roller 44 in accordance with the drive of the carrying belt 41. As a result, a color toner image T is formed. The toner remaining on the photosensitive drum 31 after the transfer is removed by the respective photosensitive body cleaning device 35 and collected in the waste toner box 36. The continuous sheet P, on which the toner image T has been transferred, is thereafter carried to the fusing unit 14. The toner image T is fixed on the continuous sheet P in the fusing unit 14 to form a color image. The continuous sheet P, on which the toner image T has been fixed, is ejected and stacked on a stacker (not shown).

The slack sensor 15 is located on the upstream side of the fusing unit 14 for detecting the slack in the continuous sheet P. The ejection sensor 16 and the ejection motion sensor 17 are located in the fusing unit 14 for detecting the ejection of the continuous sheet P.

Next, the carrying motion of the medium between the transferring unit 40 and the fusing unit 14 is explained.

Normally, the image forming device 10 is controlled so that the carrying speed of the transfer belt is faster than the carrying speed of the fusing unit. In the case of the medium having a length similar to A4 or letter-size paper, which are often used in office environments, even if the carrying speeds at the transferring belt 41 and the fusing unit 14 are in the above-described relationship, that is, the carrying speed of the transferring belt 41 is faster than the carrying speed of the fusing unit 14, the rear end of the medium passes the transferring unit 40 before the amount of slack in the medium increases. Therefore, the slack in the medium does not become so significant so as to cause the medium to become crumpled (accordion state) in the image forming device 10.

However, in the case of the continuous sheet P having a large length, such as that in the first embodiment, the slack in the medium accumulates and can cause the medium to become crumpled in the image forming device 10. Therefore, the level of the slack in the medium is monitored by the slack sensor 15.

In the first embodiment, the lever of the slack sensor 15 is oriented in a tilted state (or down state) when there is no slack in the continuous sheet P. At this time, the slack detection part 64 outputs an output signal indicating that there is no slack to the central controller 61, and thereby the central controller 61 determines that there is no slack in the medium. On the other hand, when the slack occurs (in the first embodiment, the slack is presumed to occur above the slack sensor 15), the slack sensor 15 is oriented in an upright (or up) state. At this time, the slack detection part 64 outputs an output signal indicating that the slack is present to the central controller 61, and thereby the central controller 61 determines that there is slack. Then, the central controller 61 controls the fuser motor drive part 70.

When the central controller 61 detects the slack in the continuous sheet P, the drive system for the fusing unit 14 is accelerated via the fuser motor drive part 70 until the output from the slack detection part 64 indicates that the slack is no longer detected. When the slack in the continuous sheet P is no longer detected, the drive system for the fusing unit 14 is decelerated until the slack is detected via the fuser motor drive part 70. The carrying of the continuous sheet P is thus controlled by repeating the detection of the slack in the continuous sheet P and the acceleration and deceleration of the drive system for the fusing unit.

(Operation for Detecting Carrying State of Continuous Sheet in First Embodiment)

Figure 4A:
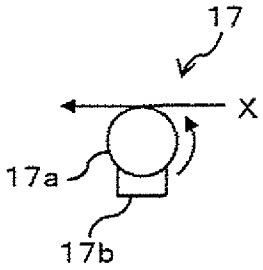
FIGS. 4A and 4B are explanatory diagrams illustrating a motion for detecting a carrying status of the continuous sheet using an ejection motion sensor.

In FIG. 4A, the ejection motion sensor 17 is configured from a rotator 17*a* and a Hall element 17*b*. The continuous sheet P is carried in the carrying direction X. In accordance with the carrying of the continuous sheet P, the rotator 17*a* rotates in the counterclockwise direction. The Hall element 17*b* is a magnetic sensor that uses Hall effects and has a function to convert the magnetic field generated by magnet or by electric current into electric signals. With this configuration of the rotator 17*a* and the Hall element 17*b*, the ejection motion sensor 17 detects amount and direction of movement of the continuous sheet P.

Figure 4B:
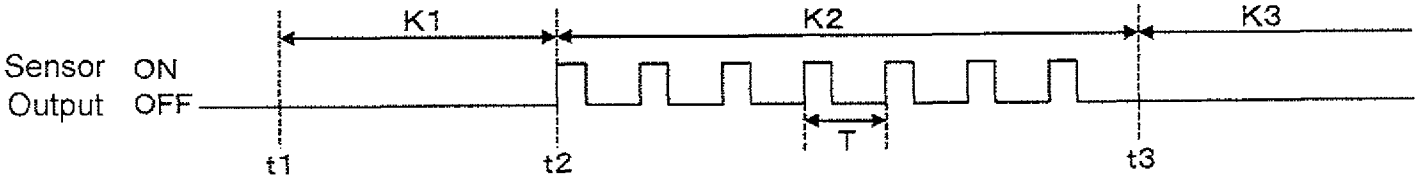

In FIG. 4B, the period K1 indicates a state before the commencement of printing, in which the rotator 17*a* of the ejection motion sensor 17 does not rotate because the continuous sheet P is not present. In addition, the ejection sensor 16 is not tilted and stands upright. As a result, the ejection motion sensor 17 outputs an OFF state signal to the ejection detection part 63. In addition, at this time, the ejection sensor 16 outputs a signal to the ejection detection part 63 indicating that there is no continuous sheet P. Based on the above results, the ejection detection part 63 outputs a signal to the central controller 61 indicating that the continuous sheet P does not exist. At time t2, when the printing is commenced, the rotator 17*a* starts rotating as the continuous sheet P is carried, and pulses are generated at a constant frequency (T) by the Hall element 17*b* during the period K2. In addition, the ejection sensor 16 is tilted. As a result, the ejection motion sensor 17 outputs an ON state signal to the ejection detection part 63. In addition, at this time, the ejection sensor 16 outputs to the ejection detection part 63 a signal indicating the presence of the continuous sheet P. Based on the above results, the ejection detection part 63 outputs a signal to the central controller 61 indicating that the continuous sheet P is being ejected normally.

When a jam occurs at time t3 during the print motion, the pulses at the constant frequency are no longer generated as indicated in the period K3 because the carrying of the continuous sheet P has stopped. Moreover, the ejection sensor 16 is tilted because the sheet is present. As a result, the ejection motion sensor 17 outputs the OFF state signal to the ejection detection part 63, and the ejection sensor 16 outputs to the ejection detection part 63 a signal indicating the presence of the continuous sheet P. Based on the above results, the ejection detection part 63 outputs a signal to the central controller 61 indicating that an ejection jam of the continuous sheet P has occurred. As a result, the central controller 61 determines that a jam has occurred.

(Detection Operation for Jam near Fusing Unit in First Embodiment)

Figure 5A:
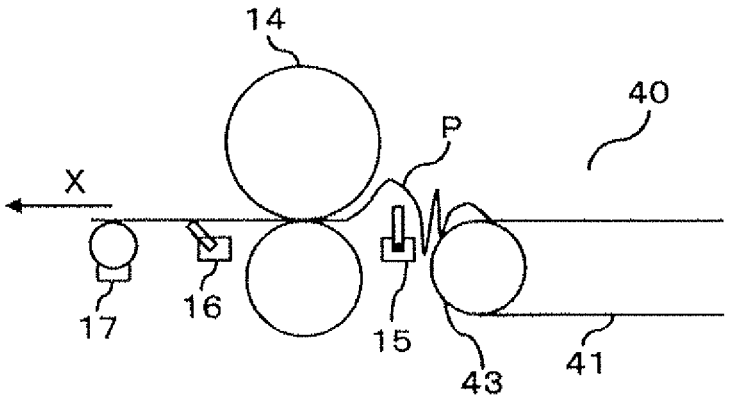
FIGS. 5A-SC are diagrams illustrating states in which a jam of a continuous sheet has occurred near the fusing unit in FIG. 1.

FIG. 5A shows a state in which the continuous sheet P is folded in an accordion shape between the transferring unit 40 and the fusing unit 14. In this state, the drive motor for the fusing unit 14 is first stopped as a result of a loss of synchronism. Until the jam is detected, the transferring belt drive roller 43 continues the carrying motion. Therefore, the continuous sheet P is driven from the upstream side to the downstream side. As a result, the continuous sheet P is wrinkled and folded in the accordion state.

When the above accordion state occurs, the continuous sheet P creates an arch near the slack sensor 15. Because the continuous sheet P does not contact the slack sensor 15 in this state, the lever is not tilted. As a result, at this time the slack detection part 64 outputs to the central controller 61 an output signal that there is slack, and the central controller 61 determines that the slacked state has occurred.

A stepping motor is used for the drive motor. The loss of synchronism occurs at the drive motor when the synchronization between the input pulse signals and the motor rotation is lost with overload and rapid changes in speed.

Causes for the loss of synchronism for the motor of the fusing unit 14 include application of a strong force on the continuous sheet P after ejection, and the continuous sheet P is rapidly strained, and saturation of the continuous sheet P after it accumulates in a stacker (not shown), and thus the load to carry the continuous sheet P increases.

Figure 5B:
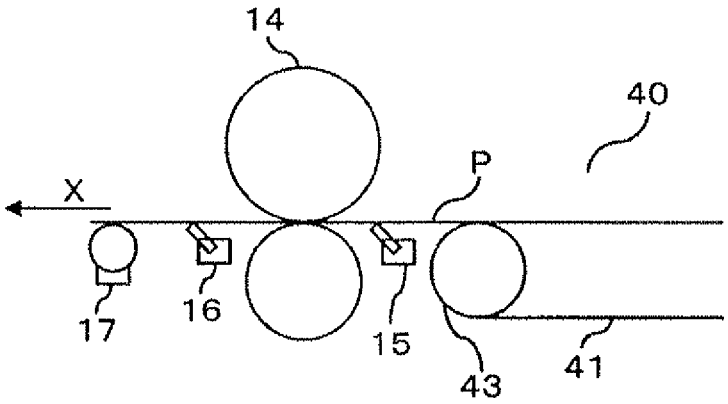

FIG. 5B shows a state in which the continuous sheet P is stopped while being strained. In contrast with FIG. 5A, in this state, the motor for the transferring belt drive roller 43 is first stopped due to the loss of synchronism, and thereby a large enough load is applied to the fusing unit 14 to cause it to be unable to carry the continuous sheet P. Therefore, the motor for the fusing unit 14 also loses synchronism, resulting in stoppage of the motors for both the transferring belt drive roller 43 and the fusing unit 14. In this case, based on the output from the ejection motion sensor 17, the central controller 61 determines that the carrying of the continuous sheet P has stopped. Therefore, the central controller 61 determines that a jam has occurred. The slack detection part 64 at this time outputs an output signal indicating no slack to the central controller 61, and the central controller 61 determines that there is no slack in the medium. A cause for the loss of synchronism at the motor for the transferring belt drive roller 43 is presumed to be a rapid load on the belt carriage on the sheet supply side (part on the upstream side of the transferring unit 40).

Figure 5C:
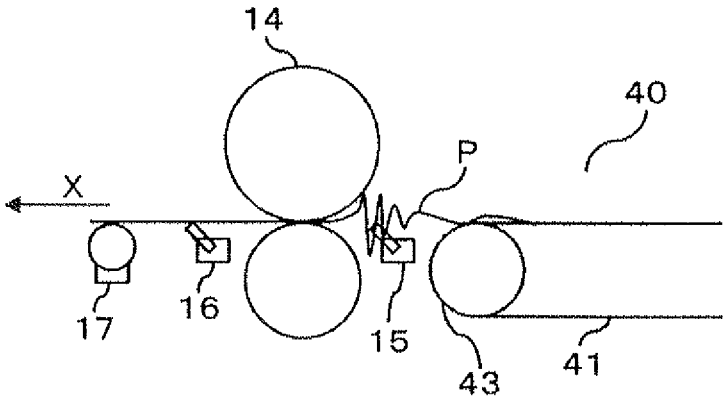

FIG. 5C shows a state in which continuous sheet P pushes down the slack sensor 15 even during the occurrence of the accordion state.

The condition for this occurrence is similar to that for FIG. 5A. However, there are cases where the motions stop in the state shown in FIG. 5C depending on the type and/or position of the continuous sheet P. Because the lever of the slack sensor 45 is tilted, the central controller 61 determines that there is no slack in the continuous sheet P.

(Motion of Medium Carrying Device in Image Forming Device in First Embodiment)

Figure 6:
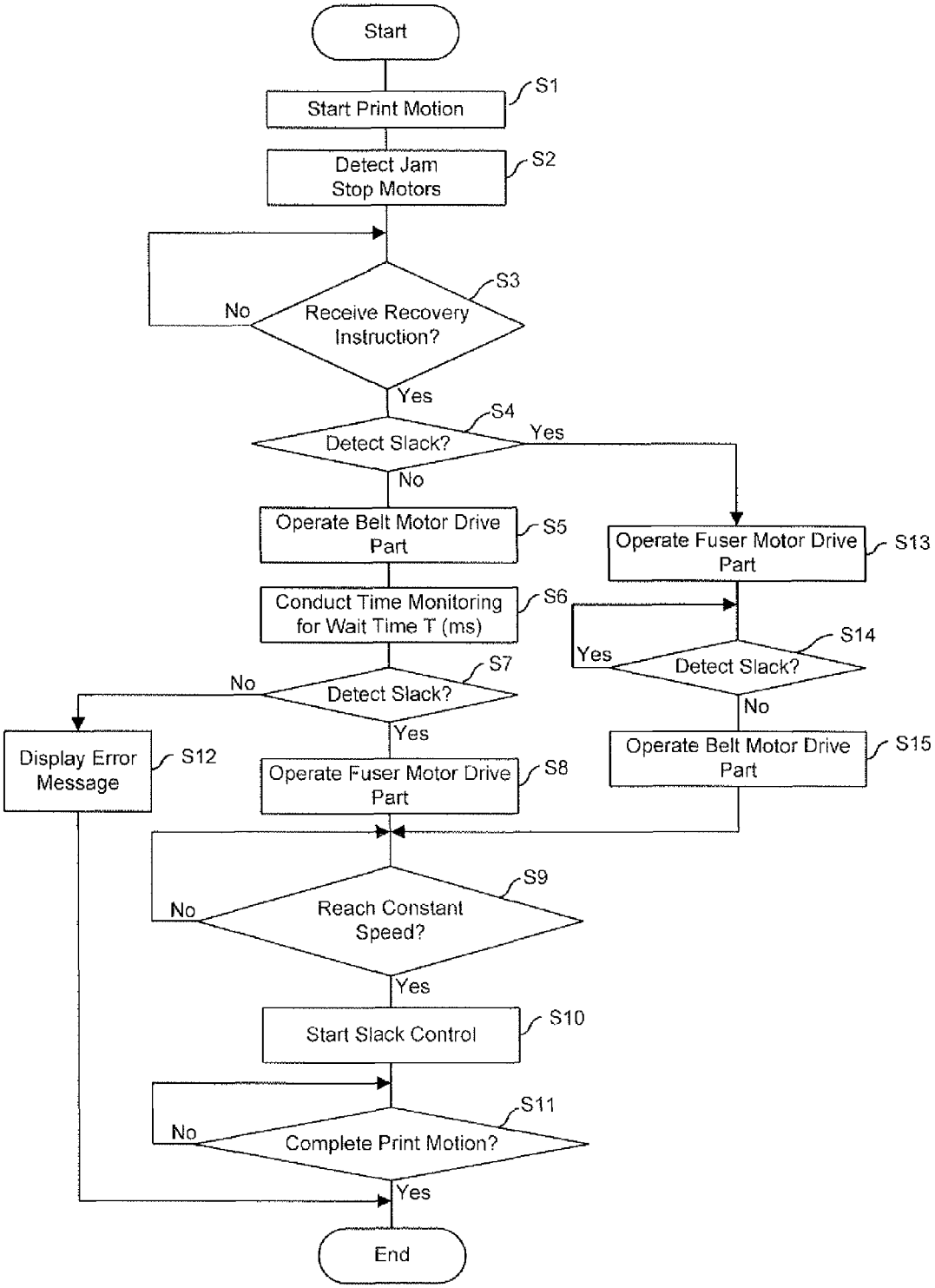
FIG. 6 is a flow diagram illustrating a motion of the image forming device in FIG. 2.

In FIG. 6, the motion of the image forming device 10, in particular, the motion of the medium carrying device in the image forming device 10, is described.

As described above, the medium carrying device in the first embodiment is configured from the drive system for the transferring unit 40, the slack sensor 15, the drive system for the fusing unit 14, the ejection sensor 16 and the ejection motion sensor 17.

The process is started when the print data is received from a host device. At S1, the print motion is started. At S2, the central controller 61 determines from output signals from the ejection motion sensor 17 and the ejection sensor 16, via the ejection detection part 63, that a jam has occurred. When the central controller 61 detects a jam (first medium carrying abnormality detection process), the central controller 61 stops the carrying of the medium by sending the registration carrying motor drive part 66, the registration supply motor drive part 67, the drum drive part 68, the belt motor drive part 69 and the fuser motor drive part 70 an instruction to stop their motors (stop process).

At S3, a determination is made as to whether a recovery instruction has been received from the user. The recovery instruction is performed when the user depresses the input operation key 83 on the operation panel 80. More specifically, when a recovery key 83*d* among the input operation key 83*d* is depressed, the user key input receiving part 65 receives a recovery instruction and sends information of the key input to the central controller 61. When there is no recovery instruction (S3, No), the process repeats S3. When there is a recovery instruction (S3, Yes), the process moves to S4. The reason for the recovery key 83*d* to be depressed by the user is to provide the user with an opportunity to confirm the abnormal state of the image forming device 10 and to perform the recovery motion when the user judges that an automatic recovery can be performed.

At S4, the slack detection part 64 checks the output signal of the slack sensor 15. When the slack detection part 64 detects no slack in the continuous sheet P (S4, No), the process moves to S5. In this case, it is presumed that the belt motor drive part 69 has lost synchronism. At this time, the central controller 61 first resumes the belt motor drive part 69, and the process moves to S6. At S6, the central controller 61 conducts a time monitoring only for a wait time (T) (ms). After the wait time (T) has elapsed, the process moves to S7 to again check whether or not there is the slack in the continuous sheet P using the slack detection part 64 (second medium carrying abnormality detection process, or slack detection process).

When the slack is still not detected (S7, No), it is determined that the carrying system has a problem, and the process jumps to S12. At S12, the central controller 61 displays an error message on a display panel 81 of the operation panel 80 via the user key input receiving part 65. In addition, the central controller 61 sends the registration carrying motor drive part 66, the registration supply motor drive part 67, the drum drive part 68, the belt motor drive part 69 and the fuser motor drive part 70 an instruction to stop their motors, and stops the motion (stop process).

When the slack is detected at S7 (S7, Yes), the process continues to S8. At S8, the central controller 61 sends the fuser motor drive part 70 an instruction to resume the motion of the drive system for the fusing unit 14. The process then moves to S9.

At S9, the speed of the drive systems for both the belt motor drive part 69 and the fuser motor drive part 70 is monitored to determine whether both drive systems (belt motor and fuser motor) have reached a constant speed. When the speed has reached a constant speed (S9, Yes), the process moves to S10. At S10, the normal medium slack control is performed. The normal medium slack control is a process to repeat increasing the speed of the drive system for the fusing unit 14 via the fuser motor drive part 70 when the slack sensor 15 detects the slack in the continuous sheet P during the normal printing and decreasing the speed when the slack is not detected. When it is determined at S11 that the print motion is completed, the process ends.

At S4, when the slack sensor 15 detects the slack in the continuous sheet P (S4, Yes), it is presumed that the fuser motor drive part 70 has lost synchronism, and the process moves to S13. At S13, the fuser motor drive part 70 resumes the motion of the fuser motor drive part 70 that is a part of the drive system for the fusing unit 14. At S14, the state of the continuous sheet P is again checked using the slack detection part 64 (third medium carrying abnormality detection process, or slack detection process). This step is repeated until the slack is no longer detected. When the slack is no longer detected (S14, No), the process moves to S15 to resume the motion of the belt motor drive part 69. The process then moves to S9. The motion at and after S9 is as described above.

The fusion control during the time of the jam occurrence is performed as discussed below. Because unfused toner exists on the continuous sheet P at the time of the jam occurrence, a fusion offset occurs unless a certain fusing temperature is maintained. When the fusing unit 14 is maintained at the certain temperature, the normal fusion control is performed when the jam state is quickly recovered.

However, when the fusion temperature control is executed while a jammed medium (or continuous sheet) exists in the fusing unit 14 and while the fusing unit 14 is in the carrying stop state, a mark of a fuser nip part could be printed on the continuous sheet P. Therefore, the carrying of the continuous sheet P may be forcefully resumed after a certain length of time (e.g., 30 sec.) has elapsed from the jam occurrence. Alternatively, the fusion control is immediately terminated at the time of the jam occurrence, and the fusing temperature control may be resumed when the user performs the recovery control from the operation panel 80. When a target temperature is not reached by heating the fusing unit 14 for a certain length of time (e.g., 30 sec.), it is determined that the jam is not recoverable, and the fusing temperature control is operated to be terminated.

The fusion offset means that a large amount of toner is excessively melted and attached to the roller part of the fusing unit 14 when the temperature of the fusing unit 14 is high, and that the toner is not sufficiently fused when the temperature is low as the amount of heat necessary for melting the toner is insufficient.

(Advantages of First Embodiment)

Conventionally, the image forming device 10 is often immediately stopped when a jam occurs, and the jammed medium has to be removed by the user. In such a case, the user needs to open the device cover and remove the photosensitive drum 31, for example.

The following advantages (1)-(3) are available with the medium carrying device and the image forming device 10 in the first embodiment:

(1) When the continuous sheet P causes a jam in the device, the recovery motion may be possible regardless of the existence of a slack in the continuous sheet P;

(2) At that time, the recovery may be possible only with key operations without the user having to open the device cover when the jam occurs; and (3) Because the jam recovery process is performed after the key operation by the user is input, the cause of the loss of synchronism at the belt motor drive part 69 and the fuser motor drive part 70 can be removed prior to the jam recovery process.

Second Embodiment (Configuration of Second Embodiment)

Figure 7:
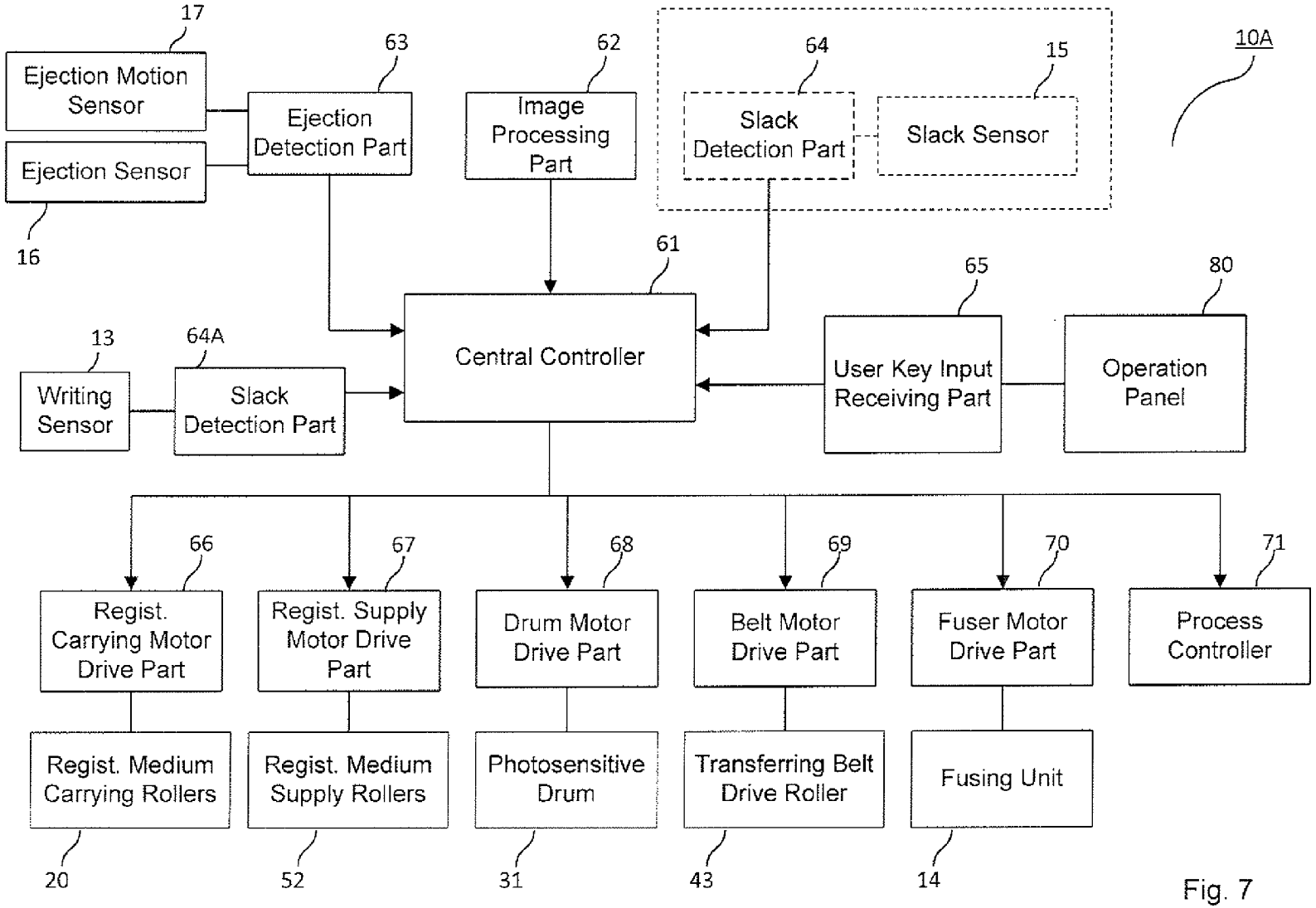
FIG. 7 is a functional block diagram illustrating the image forming device in FIG. 1 according to a second embodiment of the present invention.

In FIG. 7, elements that are similar to those in FIG. 2 showing the first embodiment are indicated by the same symbols.

An image forming device 10A in the second embodiment has a configuration that a slack detection part 64A is replaced with the slack detection part 64 in the first embodiment. The other configurations are similar to those in the first embodiment. In addition, to show another embodiment, the combination of the first and second embodiments, the slack detection part 64 and the slack sensor 15 remain within a dotted grid.

In the second embodiment, a recovery of a jam between the first carrying part (e.g., the drive system for the registration unit, that is the registration medium carrying rollers 12), which is on the upstream side of the image forming part 20, and the second carrying part (e.g., the drive system for the transferring unit 40) is described. The second embodiment has features that an additional slack sensor is not provided and that the writing sensor 13 is used as a slack sensor. The slack detection part 64A receives an output signal from the writing sensor 13 and controls the writing sensor 13 based on the instruction from the central controller 61. Different from the first embodiment, in the second embodiment, the registration medium carrying rollers 12 functions as the first carrying part, the transferring unit 40 functions as the second carrying part.

In the second embodiment, the first position is where the transferring unit 40 is located, and the second position is where the fusing unit 14 is located.

(Detecting Motion of Carrying State of Continuous Sheet in Second Embodiment)

Figure 8A:
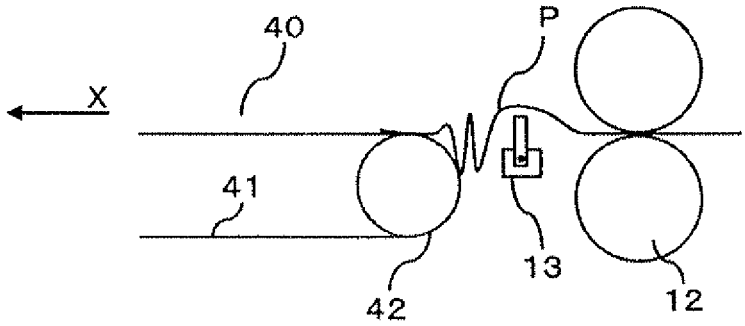
FIGS. 8A-8C are diagrams illustrating states in which a jam of a continuous sheet occurs near the entrance of the image forming part in FIG. 1.

FIG. 8A shows a state in which the continuous sheet P has been folded in the accordion state between the registration medium carrying rollers 12 and the transferring unit 40. This is a state in which the belt motor drive part 69 is stopped first as a result of the loss of synchronism and in which the registration carrying motor drive 66 has continued to carry the continuous sheet P from the upstream side to the downstream side until the jam is detected.

In FIG. 8A, the continuous sheet P forms a large arc near the writing sensor 13 and does not contact the writing sensor 13. Therefore, the central controller 61 determines the slacked state. Similar to the first embodiment, the cause of the loss of synchronism by the belt motor may be that the continuous sheet P after ejection was rapidly strained by some large force applied on the continuous sheet P, or that a large load was required for carrying the continuous sheet P as the continuous sheet P was accumulated and saturated in a stacker (not shown).

Figure 8B:
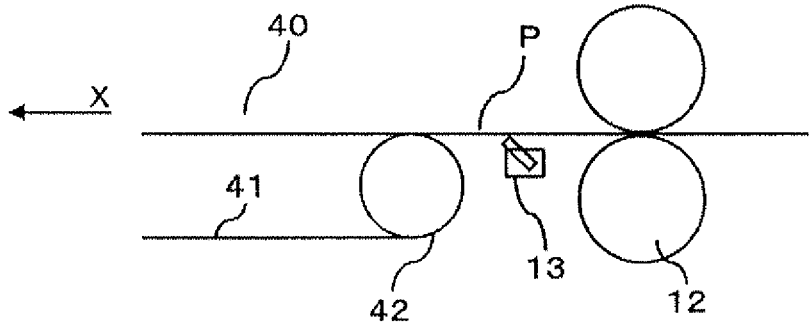

FIG. 8B shows a state in which the medium stops as it is strained. Unlike the state shown in FIG. 8A, this is a state in which the motor for the registration carrying motor drive part 66 stops first as a result of the loss of synchronism and in which a large load, with which the continuous sheet P cannot be carried, is applied to the belt motor drive part 69. As a result, the motor for the belt motor drive part 69 also loses synchronism, causing the jam. In this state, the writing sensor 13 detects no slack. A rapid load on the sheet supply side (registration medium carrying rollers 12) can be presumed as a cause for this situation.

Figure 8C:
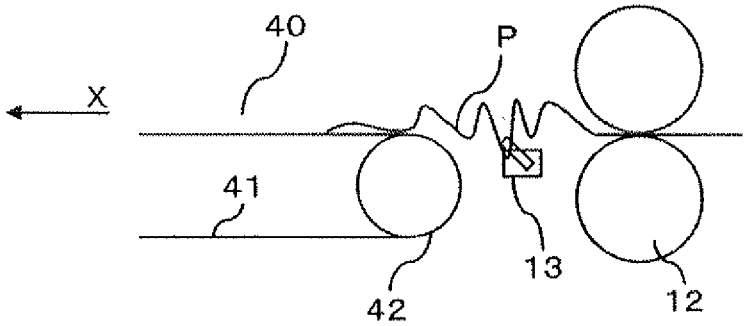

FIG. 8C shows a state in which the continuous sheet P is folded in the accordion state between the registration medium carrying rollers 12 and the transferring unit 40 but is pushing down the writing sensor 13. The cause of this state may be similar to that for the state shown in FIG. 8A; however, the motion may stop as shown in FIG. 8C depending on the position or type of the continuous sheet P. Because the lever of the writing sensor 13 is down, the central controller 61 determines that there is no slack in the continuous sheet P.

(Motion of Medium Carrying Device in Image Forming Device 10A in Second Embodiment)

Figure 9:
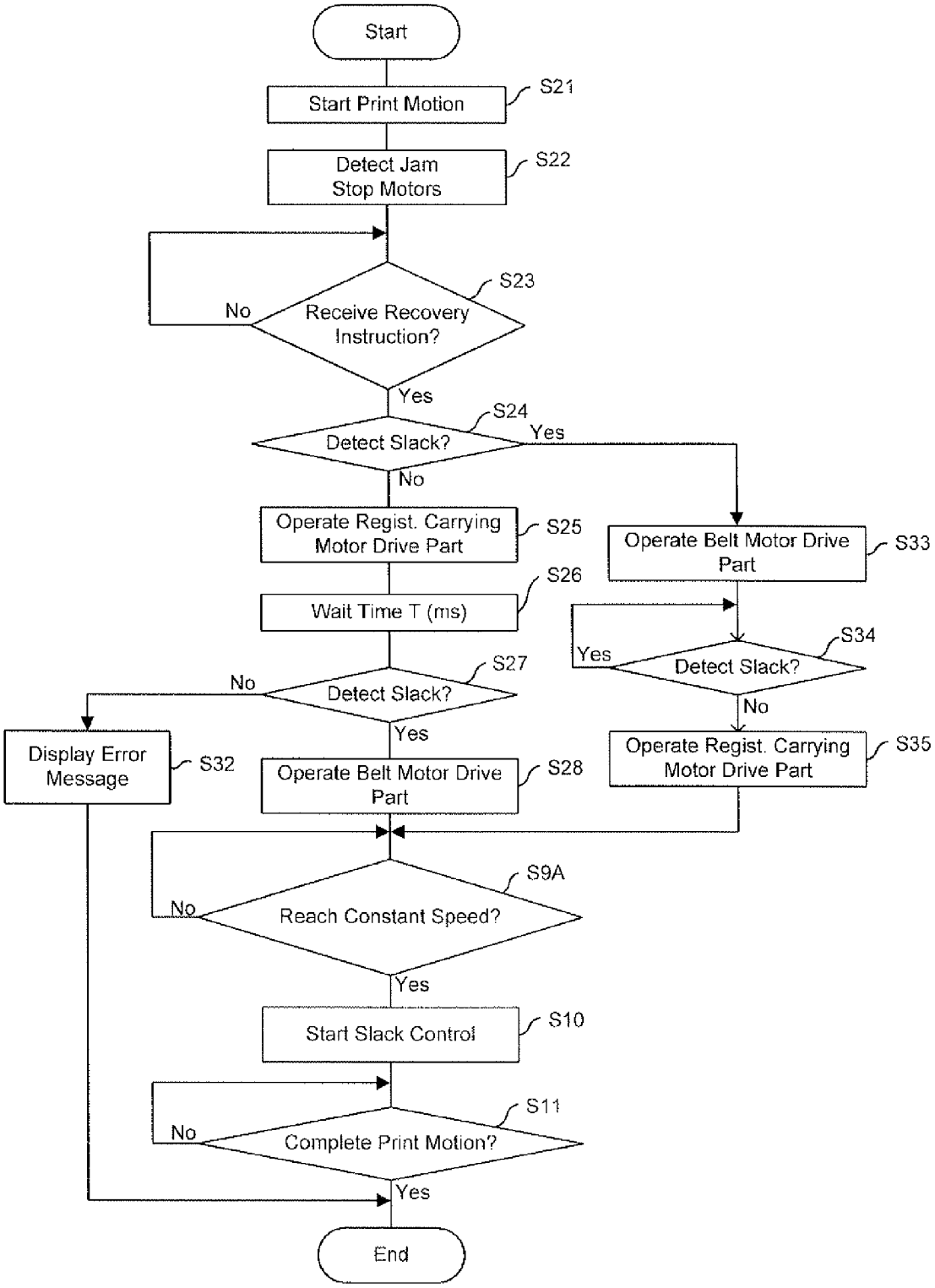
FIG. 9 is a flow diagram illustrating a motion of the image forming device in FIG. 7.

In FIG. 9, the same numbers are used for the elements that are common with those in FIG. 6 showing the first embodiment.

In the motion of the flow diagram of the second embodiment, instead of steps S1-S8 and S12-S15 in FIG. 6 for the first embodiment, steps S21-S28, S32-S35 and 9A are provided to perform different processes. The other steps S10 and S11 are the same as the first embodiment.

The process starts when the print data is received from the host device. At S21, the print motion starts by the continuous sheet P being carried to the image forming part 20 by the registration medium carrying rollers 12. When the front end of the continuous sheet P passes through the registration medium carrying rollers 12 to the writing sensor 13, the central controller 61 sends an instruction to the process controller 71 to write out the image data.

At S22, when a jam occurs while printing (namely, when a jam is detected), the central controller 61 stops the carrying of the medium by terminating all of the drive systems (stop process). Similar to the first embodiment, at S23, the process waits for the user to depress the recovery key 83*d*. When the recovery key 83*d* is depressed (S23, Yes), the process moves to S24.

At S24, a determination is made as to whether or not slack has been detected. That is, the slack detection part 64A monitors whether or not the slack has occurred on the continuous sheet P by detecting an output signal of the writing sensor 13. During the normal print motion, the writing sensor 13 detects the continuous sheet P. Therefore, the output signal always indicates a certain value (no slack state) during the normal printing.

However, when a jam occurs, the sensor lever of the writing 13 may stand upright depending on the condition of the continuous sheet P as shown in FIG. 8A. In this state, the slack is detected (first medium carrying abnormality detection process), that is, it is determined that there is slack in the continuous sheet P (S24, Yes), and the process moves to S33. The recovery motion from this step is performed by the control method similar to that in the first embodiment (medium carrying and ejection process). That is, the belt motor drive part 69 on the downstream side is first resumed at S33, and a determination is again made at step S34 as to whether or not the slack is still in the continuous sheet P (third medium carrying abnormality detection process, or slack detection process).

When the slack is still detected (S34, Yes), the process of S34 is repeated. When the slack is no longer detected (S34, No), then the process moves to S35. The registration carrying motor drive part 66 is driven at S35, and the process moves to S9.

At S24, when the slack is not detected, that is, where the sensor lever of the writing sensor 13 is tilted as shown in FIGS. 8B and 8C (S24, No), the process moves to S25. At S25, the registration carrying motor drive part 66 is first driven, and at S26, a time monitoring is conducted for certain wait time (T)(ms). After the wait time (T) has elapsed, the state of the sensor lever of the writing sensor 13 is again checked to confirm whether or not the slack is detected at S27 (second medium carrying abnormality detection process, or slack detection process).

At S27, when the slack is still not detected (S27, No), it is determined that the medium carrying state is abnormal, and the process moves to S32. At S32, an error message is immediately displayed on the display panel 81 on the operation panel 80, and the process ends. At S27, when the slack is detected (S27, Yes), the belt motor drive part 69 is driven to resume the carrying of the medium at S28, and the process moves to S9A. At S9A, the speeds of the drive systems for both the registration carrying motor drive part 66 and the belt motor drive part 69 are monitored to determine whether or not both drive systems (registration carrying motor and belt motor) have reached a constant speed. When the speed has reached a constant speed (S9A, Yes), the process moves to S10. Then, S10 and S11, which are similar to those in the first embodiment, are executed, and this process ends.

(Advantages of Second Embodiment)

According to the medium carrying device and the image forming device 10A in the second embodiment of the present invention, there are following advantages in addition to those in the first embodiment:

(1) By using the existing writing sensor 13 as a slack sensor without providing an additional slack sensor, the recovery of a jam occurring between the registration medium carrying rollers 12 and the transferring unit 40 can be easily performed; and (2) By implementing the second embodiment in combination with the first embodiment, the detection of medium jams and the recovery process can be performed at the same time on the upstream side (between the registration medium carrying rollers 12 and the transferring unit 40) and the downstream side (between the transferring unit 40 and the fusing unit 14), thereby allowing more stable recovery of jams of the continuous sheet P. In such a embodiment, the registration medium carrying rollers 12 form the first carrying part, the transferring unit 40 is the second carrying part, and the fusing unit 14 is the third carrying part.

(Exemplary Modifications)

The present invention is not limited to the above-described embodiments, and various usages and modifications are possible. Examples of such usages and modifications include the following (a) to (d):

(a) The first and second embodiments are described with the image forming devices 10 and 10A as a color page printer as an example. However, the present invention is not limited to this and may be used in facsimile machines, photocopy machines and multifunction machines, or the like;

(b) The drive systems are not limited to stepping motors; direct current (DC) motors may be used;

(c) The first and second embodiments are described with the continuous sheet P as a medium. However, a cut sheet (or rectangular shaped sheet) may be used if it is a long medium; and (d) The first and second embodiments are described with the medium carrying device and the medium carrying method implemented in the image forming devices 10 and 10A. However, the medium carrying device and the medium carrying method can be used in a device that carries a long medium, other than the image forming devices 10 and 10A. For example, a receipt and journal printing mechanism for an automatic teller machine (ATM) and a receipt printing mechanism for a store cash register may be considered.

What is claimed is:

1. A medium carrying device, comprising:

a first carrying part that carries a medium to a first position;

a second carrying part that is positioned on a downstream side of the first carrying part;

a medium carrying detection part that detects stoppage of carrying the medium;

a slack detection unit that is positioned between the first carrying part and the second carrying part and includes a sensor that is configured to detect presence of a slack in the medium after a medium carrying operation of both of the first carrying part and the second carrying part has stopped but before resuming the medium carrying operation of the first and second carrying parts; and a controller that:

stops the medium carrying operation of both of the first carrying part and the second carrying part based on the detection of the stoppage of carrying the medium by the medium carrying detection part, while the first carrying part and the second carrying part are operated to carry the medium, for resuming the carrying of the medium thereafter, determines which one of the first carrying part and the second carrying part should resume the medium carrying operation first based on the presence of the slack in the medium that is detected by the sensor of the slack detection unit after the medium carrying operation of both of the first carrying part and the second carrying part has stopped but before resuming the medium carrying operation of the first and second carrying parts, and resumes the medium carrying operation of a determined one of the first carrying part and the second carrying part, wherein the controller controls the slack detection unit to detect the presence of the slack in the medium while the medium carrying operation of both of the first carrying part and the second carrying part has stopped as a result of the detection of the stoppage of carrying the medium by the medium carrying detection part.

2. The medium carrying device according to claim 1, further comprising:

an input part that receives a recovery instruction from a user when the medium carrying operation of the first carrying part and the second carrying part is stopped;

a first drive part that performs drive control for the first carrying part;

a second drive part that performs drive control for the second carrying part, wherein the controller controls the first drive part and the second drive part according to a determination result for resuming when the input part receives the recovery instruction from the user.

3. The medium carrying device according to claim 2, wherein the controller first controls the second drive part to drive the second carrying part and then controls the first drive part to drive the first carrying part when the presence of the slack in the medium is detected.

4. The medium carrying device according to claim 2, wherein the controller first controls the first drive part to drive the first carrying part and then controls the second drive part to drive the second carrying part when the presence of the slack in the medium is not detected.

5. The medium carrying device according to claim 1, wherein the first carrying part is a drive system for a transferring unit that transfers an image onto the medium, and the second carrying part is a drive system for a fusing unit that fuses the transferred image onto the medium.

6. The medium carrying device according to claim 1, wherein the first carrying part is a drive system for a registration unit that carries the medium to a transferring unit, and the second carrying part is a drive system for the transferring unit that transfers an image onto the medium.

7. The medium carrying device according to claim 1, wherein the medium carrying detection part includes an ejection motion sensor that includes a rotator that rotates in accordance with the carrying of the medium, and the ejection motion sensor detects whether or not the medium is being carried in response to the rotation of the rotator.

8. The medium carrying device according to claim 1, wherein the slack detection unit includes a lever that is configured to have at least two different positions in response to whether or not there is the slack in the medium and a slack detection part that detects the position of the lever so that the presence of the slack is determined based on the position of the lever.

9. The medium carrying device according to claim 8, wherein the slack detection unit is located on a downstream side of an image forming part that forms an image on the medium.

10. The medium carrying device according to claim 1, wherein the medium carrying detection part includes a lever that is configured to have at least two different positions in response to whether or not the medium is present and an ejection detection part that detects the position of the lever so that the medium is detected based on the position of the lever.

11. The medium carrying device according to claim 10, wherein the lever and the ejection detection part are located on a downstream side of the second carrying part.

12. The medium carrying device according to claim 1, wherein the medium carrying detection part includes a lever that is configured to have at least two different positions in response to whether or not the medium is present and an ejection detection part that detects the position of the lever so that the medium is detected based on the position of the lever, the medium carrying detection part includes an ejection motion sensor that includes a rotator that rotates in accordance with the carrying of the medium, the ejection motion sensor detects whether or not the rotator is rotating, and a carrying state of the medium is detected based on a combination of output signals from the ejection detection part and the ejection motion sensor.

13. The medium carrying device according to claim 12, wherein the stoppage of carrying the medium is detected when the ejection detection part detects that the medium is present and when the ejection motion sensor does not detect the rotation of the rotator.

14. The medium carrying device according to claim 1, wherein the controller drives the first carrying part if the presence of the slack in the medium is not determined by the slack detection unit at the time of detection of the stoppage of carrying the medium by the medium carrying detection part, causes the slack detection unit to determine the presence of slack after a predetermined amount of time has elapsed, and causes an error message to be displayed if the presence of the slack in the medium is not determined after the predetermined amount of time has elapsed.

15. The medium carrying device according to claim 1, wherein the controller resumes the carrying of the medium after a predetermined amount of time has elapsed since the stoppage of carrying the medium is detected.

16. The medium carrying device according to claim 1, wherein the controller stops a fusion control after the detection of the stoppage of carrying the medium and resumes the medium carrying operation after resuming the fusion control when an input part receives a recovery instruction from a user.

17. An image forming device, comprising:

a first carrying part;

an image forming part configured to form an image on the medium, the image forming part including a second carrying part that is positioned on a downstream side of the first carrying part in a medium carrying direction;

a medium carrying detection part configured to detect stoppage of carrying the medium;

a writing sensor that is located between the first carrying part and the second carrying part and that is configured to detect the medium for the purpose of controlling a timing at which the image forming part forms the image and a slack in the medium;

a slack detection unit that is in communication with the writing sensor and that detects presence of the slack in the medium based on a signal received from the writing sensor after a medium carrying operation of both of the first carrying part and the second carrying part has stopped but before resuming the medium carrying operation of the first and second carrying parts; and a controller that is configured to control the medium carrying operation of the first carrying part and the second carrying part; wherein the controller stops the medium carrying operation of both of the first carrying part and the second carrying part based on the detection of the stoppage of carrying the medium by the medium carrying detection part, while the first carrying part and the second carrying part are operated to carry the medium, for resuming the carrying of the medium thereafter, the controller determines which one of the first carrying part and the second carrying part should resume the medium carrying operation first based on the presence of the slack in the medium that is detected by the writing sensor after the medium carrying operation of both of the first carrying part and the second carrying part has stopped but before resuming the medium carrying operation of the first and second carrying part, and resumes the medium carrying operation of a determined one of the first carrying art and the second carrying part, the controller controls the slack detection unit to detect the presence of the slack in the medium while the medium carrying operation of both of the first carrying part and the second carrying part has stopped as a result of the detection of the stoppage of carrying the medium by the medium carrying detection part.

18. The medium carrying device according to claim 17, wherein the writing sensor includes a lever that is configured to have at least two different positions in response to whether or not the slack in the medium exists, and the slack detection part is configured to detect the position of the lever so that the presence of the slack in the medium is determined based on the position of the lever.

19. The medium carrying device according to claim 17, wherein after first driving the first carrying part, the controller causes an error message to be displayed if the presence of the slack in the medium is not detected after a predetermined amount of time has elapsed.

20. The medium carrying device according to claim 17, wherein the controller resumes the medium carrying operation after a predetermined amount of time has elapsed since the stoppage of carrying the medium is detected.

21. The medium carrying device according to claim 17, wherein the controller stops a fusion control after the detection of the stoppage of carrying the medium and resumes the medium carrying operation after resuming the fusion control when a recovery instruction is received from a user via an input part.

22. A medium carrying method, comprising:

performing a medium carrying operation using a first carrying part and a second carrying part positioned in a downstream side of the first carrying part in a medium carrying direction;

detecting stoppage of carrying the medium by a medium carrying detection part;

stopping the medium carrying operation of both of the first carrying part and the second carrying part based on the detection of the stoppage of carrying the medium, while the first carrying part and the second carrying part are operated to carry the medium;

detecting presence of a slack in the medium by a slack detection unit positioned between the first carrying part and the second carrying part while the medium carrying operation of both of the first carrying part and the second carrying part has stopped as a result of the detection of the stoppage of carrying the medium;

for resuming the medium carrying operation of the first carrying part and the second carrying part, determining which one of the first carrying part and the second carrying part should resume the medium carrying operation first based on the presence of the slack in the medium that is detected after the medium carrying operation of both of the first carrying part and the second carrying part has stopped; and resuming the medium carrying operation of a determined one of the first carrying part and the second carrying part.

23. The medium carrying method according to claim 22, wherein when the presence of the slack in the medium is not determined by the slack detection process, the first carrying process is resumed before the second carrying process is resumed, then the detection of the presence of the slack in the medium is resumed after a predetermined time elapses.

24. The medium carrying method according to claim 22, wherein when the presence of the slack in the medium is determined by the slack detection process, the second carrying process is resumed, then the detection of the presence of the slack in the medium is repeated until the presence of the slack in the medium is no longer detected.

25. The medium carrying method according to claim 24, wherein after the presence of the slack in the medium is no longer detected, the first carrying process is resumed.

26. The medium carrying method according to claim 22, wherein after stopping the medium carrying operation, the medium carrying operation of the first carrying part is resumed if the presence of the slack in the medium is not detected, after the medium carrying operation of the first carrying process is resumed, the presence of the slack in the medium is again determined after a predetermined amount of time has elapsed, and the medium carrying method further comprises displaying an error message if the presence of the slack in the medium is not detected after the predetermined amount of time has elapsed.

27. The medium carrying method according to claim 22, wherein the medium carrying operation is resumed after a predetermined amount of time has elapsed since the stoppage of carrying the medium is detected.

28. The medium carrying method according to claim 22, further comprising stopping a fusion control after the stoppage of carrying the medium is detected, wherein the medium carrying operation is resumed after resuming the fusion control when a recovery instruction is received from a user.

* * * * *